US012084227B2

(12) United States Patent
Goon et al.

(10) Patent No.: US 12,084,227 B2
(45) Date of Patent: Sep. 10, 2024

(54) REPOSITIONING AND RETAINING DEVICE FOR MAIL DELIVERY TRAYS AND METHOD OF USING THE SAME

(71) Applicant: JBF Products LLC, Winchester, OH (US)

(72) Inventors: Jessica M. Goon, Winchester, OH (US); Taylor M. Goon, Winchester, OH (US)

(73) Assignee: JBF Products LLC, Winchester, OH (US)

( * ) Notice: Subject to any disclaimer, the term of this patent is extended or adjusted under 35 U.S.C. 154(b) by 0 days.

(21) Appl. No.: 17/737,558

(22) Filed: May 5, 2022

(65) Prior Publication Data

US 2023/0159225 A1 May 25, 2023

Related U.S. Application Data

(60) Provisional application No. 63/282,656, filed on Nov. 23, 2021.

(51) Int. Cl.
*B65D 1/34* (2006.01)
*B65D 25/06* (2006.01)

(52) U.S. Cl.
CPC ..... *B65D 25/06* (2013.01); *B65D 1/34* (2013.01)

(58) Field of Classification Search
CPC ..... B65D 1/34; B65D 25/06
USPC ..... 206/561, 820; 220/529, 534, 543–545
See application file for complete search history.

(56) References Cited

U.S. PATENT DOCUMENTS

| | | | | |
|---|---|---|---|---|
| 1,713,328 | A * | 5/1929 | Brenner | A47J 36/20 220/543 |
| 1,995,335 | A * | 3/1935 | Wilke | A47F 5/005 220/543 |
| 4,102,470 | A * | 7/1978 | Timmons | A47B 88/975 220/543 |
| 6,073,794 | A * | 6/2000 | Bidot | A47B 88/975 312/348.3 |
| 6,290,063 | B1 * | 9/2001 | Vogt | B60N 3/103 220/574 |
| 8,833,881 | B2 * | 9/2014 | Manniso | A47B 88/90 312/265.5 |
| 9,072,378 | B2 * | 7/2015 | Baum | A47B 88/90 |

(Continued)

*Primary Examiner* — Luan K Bui
(74) *Attorney, Agent, or Firm* — Wood Herron & Evans LLP

(57) ABSTRACT

A repositioning and retaining device for a mail delivery tray is provided. The device includes a central body to receive at least one mailpiece thereagainst. The central body defines a substantially planar surface. The device also includes at least one intermediate portion operatively connected and arranged substantially perpendicular to the central body. The at least one intermediate portion provides a lateral boundary for the at least one mailpiece. The device further includes at least one peripheral guide extending outward from and in a direction transverse to the central body and operatively connected to the at least one intermediate portion. The at least one peripheral guide engages with a sidewall of the tray to orient and removably secure the device to the tray. A system for repositioning and retaining mail and a method of using the repositioning and retaining device for a mail delivery tray are also provided.

19 Claims, 6 Drawing Sheets

(56) References Cited

U.S. PATENT DOCUMENTS

| | | | | |
|---|---|---|---|---|
| 2007/0273258 | A1* | 11/2007 | Ernst | A47B 88/90<br>312/348.3 |
| 2012/0037520 | A1* | 2/2012 | Cline | A47B 41/00<br>206/214 |

* cited by examiner

REPOSITIONING AND RETAINING DEVICE FOR MAIL DELIVERY TRAYS AND METHOD OF USING THE SAME

CROSS-REFERENCE TO RELATED APPLICATIONS

This application claims priority to, and the benefit of the filing date of, U.S. Provisional Application No. 63/282,656 filed on Nov. 23, 2021, the entire contents of which are hereby incorporated by reference.

TECHNICAL FIELD

This application relates generally to mail delivery and, more particularly, to a device and method of use thereof for repositioning and retaining mail within a mail delivery tray.

BACKGROUND

This section is intended to introduce the reader to various aspects of art that may be related to various aspects of the present invention, which are described and/or claimed below. This discussion is believed to be helpful in providing the reader with background information to facilitate a better understanding of various aspects of the present invention. Accordingly, it should be understood that these statements are to be read in this light, and not as admissions of prior art.

Delivering mail is a fast-paced manual effort that requires delivery professionals to balance competing interests. Delivery professionals must be detail-oriented and accurate to ensure that mail is delivered to the correct location. However, delivery professionals must also perform their tasks quickly so that mail is delivered in a timely manner. Balancing the competing interests of accuracy and speed is further complicated by the need for delivery professionals to execute their duties safely.

Mail is transported from large distribution centers to local Post Offices where the mail is organized into trays. The trays of mail are then transferred from the Post Office to delivery vehicles so that individual mailpieces can be subsequently delivered to a final location. While delivering mail, a delivery professional will remove the mailpieces from the trays. As mailpieces are removed from the mail tray the remaining mailpieces can become loose and slide around. This can cause the mailpieces to become unorganized and out of order. If the mailpieces become unorganized, a delivery professional must spend time and effort to reorganize the mailpieces in the trays at each delivery point to ensure that all of the correct mailpieces are delivered.

The additional time to look through and reorganize the mailpieces at every stop adds time and inefficiency to the delivery process. The reorganization can also cause safety issues if the delivery professional is tempted to try to prevent mailpieces from sliding and becoming unorganized while driving and/or reorganizing the mail while they are driving between delivery points. Furthermore, there is also the potential for incorrect (e.g., wrong or missed) delivery of mailpieces should the mail become unorganized, and the additional time is not spent to reorganize the mail at each delivery point.

Certain devices have been developed and utilized in an attempt to retain mail in an organized fashion within the tray as mail is removed from the trays. Devices currently available to delivery professionals have many limitations and drawbacks that do not address all of the issues recognized by delivery professionals. These issues include (but are not limited to): required user assembly, components that can come loose during use, required permanent attachment to the tray, required adhesive for attachment (that can deteriorate over time), lack of features to keep the device in position, insufficient coverage for the size and shape of mailpieces, the ability to easily reposition, etc.

Devices that require end user assembly may be assembled incorrectly resulting in the device not functioning as intended or becoming unusable. Assembled components may come loose from the constant vibrations caused by the delivery vehicles, which may, in turn, result in the device not functioning as intended or becoming unusable. Further, any device that requires permanent attachment to a tray does not allow for a delivery professional to switch the device from tray to tray. The devices that are not able to retain desired positions expose the device to unauthorized and unexpected repositioning causing the mail to become unorganized and out of order. Also, insufficient coverage of the mailpieces may cause the mailpieces to slide under or flip over the top of the device. In these circumstances, the mailpieces may be missed during delivery.

As an alternative to purposefully developed devices, some delivery professionals make use of loose void fillers (e.g., bricks, PVC pipe, undelivered packages, etc.). This approach also has shortcomings. For example, void fillers permit only a single predetermined (e.g., by the volume of the item) position that may retain the mail. Thus, a delivery professional must remove enough mailpieces from the tray to be able to place the void filler into the tray. The loose void fillers can move around in the tray (e.g., during the turns and vibrations inherent with driving a delivery vehicle and by the repeated acceleration and deceleration) potentially causing the mail to become unorganized.

Therefore, a need exists in the field for a device capable of being easily positioned anywhere in a mail tray as the mail is depleted that retains the optimal position, location, and angle of the mail. A further need exists for a device that can be transitioned from one tray to another tray and not require the end user to remove or move mailpieces already supplied in the tray. Finally, there is also a need for the device to be available to the end user as a single piece device that will not require any intervention (e.g., assembly, etc.) by the end user to retain functionality throughout the use of the device.

Accordingly, it would be desirable to provide a mail repositioning and retaining device and method of use thereof that avoids, alleviates, or otherwise minimizes the drawbacks or shortcomings of existing devices.

SUMMARY

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be explicitly set forth below.

As described above, there presently are drawbacks or shortcomings of existing devices for retaining and positioning mail. And so, in one aspect, the present invention avoids, alleviates, or otherwise minimizes these drawbacks or shortcomings. To accomplish this, embodiments of the repositioning and retaining device for mail delivery trays, in accordance with principles of the inventions, are disclosed.

In one aspect of the invention, a repositioning and retaining device for a mail delivery tray is provided. The device includes a central body configured to receive a mailpiece thereagainst. The central body defines a substantially planar surface. The device also includes at least one intermediate portion operatively connected and arranged substantially perpendicular to the central body. The at least one intermediate portion is configured to provide a lateral boundary for the mailpiece. The device further includes at least one peripheral guide that extends outward from and in a direction transverse to the central body and is operatively connected to the at least one intermediate portion. The at least one peripheral guide is configured to engage with a sidewall of the tray to orient the device relative to the tray and to removably secure the device to the tray.

In one embodiment, the device may include at least one retention feature. The retention feature may be configured to interact with the tray to minimize undesired movement of the device relative to the tray. The central body may include the at least one retention feature. The at least one retention feature may include a plurality of fins extending away from a bottom of the central body. Alternatively, the at least one retention feature may be included on a flange. In such an embodiment, the at least one peripheral guide may include a downwardly extending flange. An interior surface of the flange may be configured to interact with an exterior surface of the sidewall of the tray. Then, the at least one retention feature may include a plurality of ridges extending from the interior surface of the flange towards the central body. Or the at least one retention feature may include a protruding lip extending from a distal end of the flange towards the central body.

In another embodiment, the at least one peripheral guide may include a first peripheral guide and a second peripheral guide. The first peripheral guide and the second peripheral guide may extend from opposing sides of the central body. The first peripheral guide may be arranged parallel to the second peripheral guide.

In yet another embodiment, the device may be of unitary construction. Further, the device may be formed by a process selected from the group consisting of: injection molding, vacuum forming, roto-molding, and 3D printing. Moreover, the device may be formed of a material selected from the group consisting of: Acrylonitrile Butadiene Styrene (ABS), Polycarbonate (PC), Polyvinyl Chloride (PVC), any derivative of Polyethylene (PE), Polypropylene (PP), Polyamide (PA), and Polyoxymethylene (POM).

In another aspect of the invention, a system for repositioning and retaining mail is provided. The system includes a mail delivery tray. The tray includes a bottom surface. Further, the tray includes at least one sidewall extending away from the bottom surface of the tray. The system also includes a repositioning and retaining device. The device includes a central body configured to receive a mailpiece thereagainst. The central body defines a substantially planar surface. The surface is arranged at an angle relative to the bottom surface of the tray and is further configured to arrange the mailpiece at the angle. The device also includes at least one intermediate portion operatively connected to the central body. The at least one intermediate portion is configured to provide a lateral boundary for the mailpiece. The device further includes at least one peripheral guide that extends outward from and in a direction transverse to the central body and is operatively connected to the at least one intermediate portion. The at least one peripheral guide is configured to engage with a sidewall of the tray to orient the device relative to the tray and to removably secure the device to the tray.

In one embodiment, the angle between the surface and the bottom surface of the tray may be between 45° and 90°. Specifically, the angle between the surface and the bottom surface of the tray may be approximately 65°.

In another embodiment, the at least one peripheral guide may include a downwardly extending flange. An interior surface of the flange may be configured to interact with an exterior surface of the sidewall of the tray. The peripheral guide may form a channel between the flange and the at least one intermediate portion. The channel may be configured to receive the sidewall of the tray therein. An exterior surface of the at least one intermediate portion may be configured to interact with an interior surface of the sidewall of the tray.

In yet another embodiment, the central body may be configured to extend to the bottom surface of the tray to prevent a mailpiece from passing between the bottom surface of the tray and the device.

In a further aspect of the invention, a method of using a repositioning and retaining device for a mail delivery tray is provided. The method includes providing the tray. The tray includes a bottom surface and at least one sidewall extending away from the bottom surface. The method further includes providing the device. The device includes a central body configured to receive a mailpiece thereagainst. The central body defines a substantially planar surface. The surface is at an angle relative to the bottom surface of the tray is configured to arrange the mailpiece at the angle. The device also includes at least one peripheral guide extending outward from the central body. The at least one peripheral guide includes a downwardly extending flange. The device further includes at least one retention feature. The at least one retention feature is configured to interact with the tray to minimize undesired movement of the device relative to the tray. The method further includes installing the device in the tray by engaging the at least one peripheral guide of the device with the sidewall of the tray to orient the device relative to the tray and to removably secure the device to the tray. The method also includes selectively translating the device along the tray.

In one embodiment, the at least one retention feature may include a plurality of fins extending away from a bottom of the central body. The plurality of fins may engage with a bottom surface of the tray.

In another embodiment, the at least one retention feature may include a plurality of ridges extending from the flange towards the central body. The plurality of ridges may engage with an exterior surface of the sidewall of the tray.

In yet another embodiment, the at least one retention feature may include a protruding lip extending from a distal end of the flange towards the central body. The lip may engage with the sidewall of the tray.

In a further embodiment, the method may further include maintaining the mailpiece at a constant angle with respect to the tray.

Advantageously, the embodiments of the present invention provide a device and method of use thereof for retaining and positioning mail that avoids, alleviates, or otherwise minimizes the drawbacks or shortcomings of existing devices for retaining and positioning mail. Other aspects, features, benefits, and advantages of embodiments of the present invention will become apparent to a person of skill in the art from the detailed description of various embodiments with reference to the accompanying drawing figures, all of which comprise part of the disclosure. The steps and elements described herein as part of various embodiments and aspects can be reconfigured and combined in different combinations to achieve the desired technical effects as may be desired. To this end, the embodiments and aspects can be combined in any combination or sub-combination.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

The exemplary embodiments described herein are provided for illustrative purposes and are not limiting. Other embodiments are possible, and modifications may be made to the exemplary embodiments within the scope of the present disclosure. Therefore, the Detailed Description is not meant to limit the scope of the present disclosure.

The terminology used herein is for the purpose of describing particular embodiments and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefits and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1A:
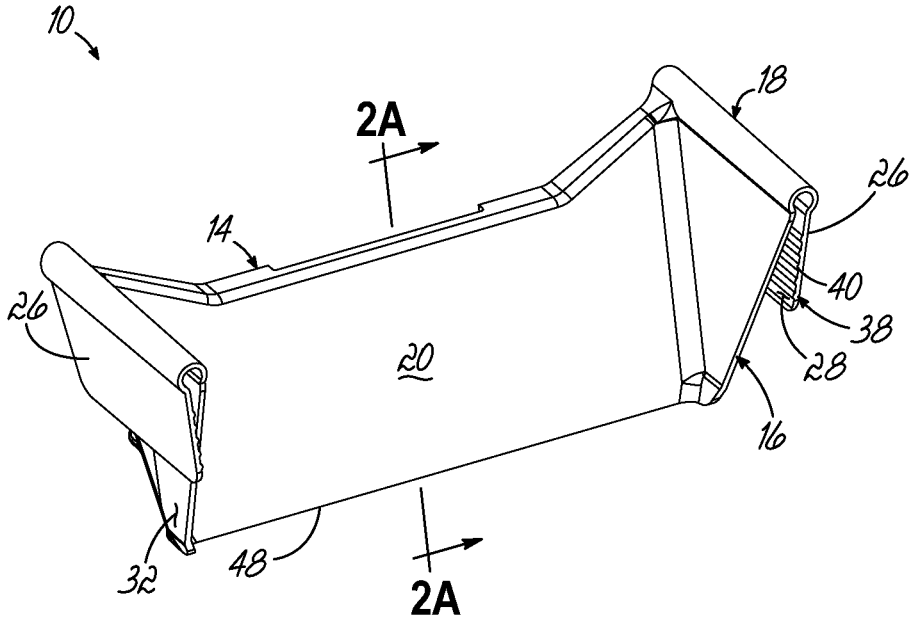
FIG. 1A is a perspective view of a first embodiment of a mail repositioning and retaining device according to principles of the present invention.
Figure 1B:
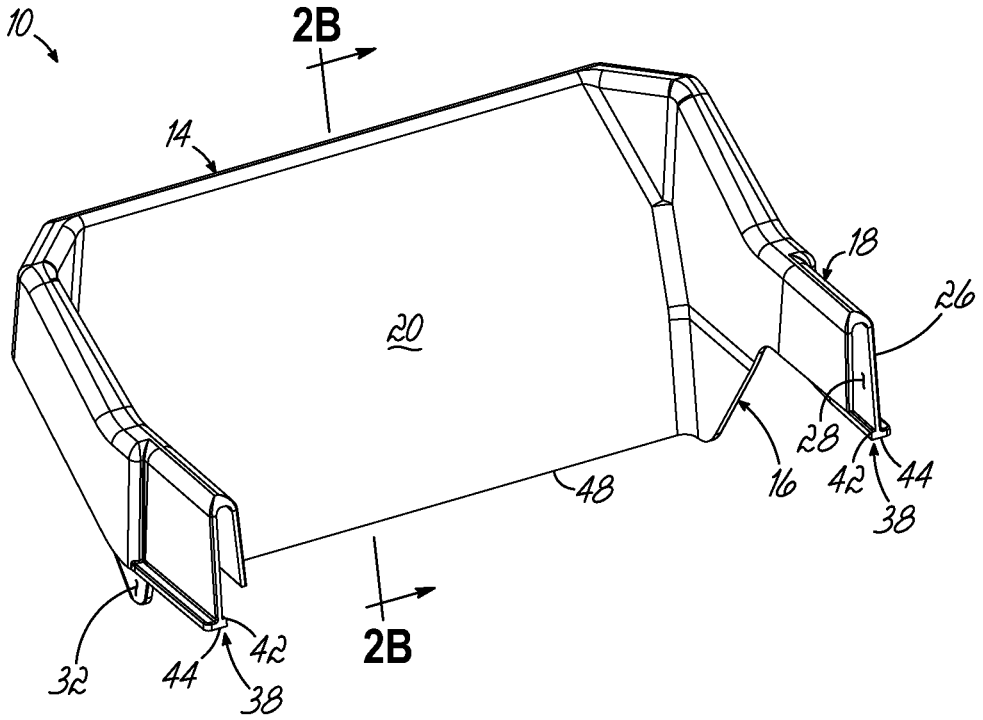
FIG. 1B is a perspective view of a second embodiment of the mail repositioning and retaining device according to principles of the present invention.

Beginning with reference to FIGS. 1A and 1B, two embodiments of the repositioning and retaining device 10 ("device") for a mail delivery tray 12 (see FIGS. 4A and 4B), in accordance with principles of the invention, are depicted. The device 10 includes a central body 14, at least one intermediate portion 16 operatively connected and arranged substantially perpendicular to the central body 14, and at least one peripheral guide 18 extending outward from a side of the central body 14 and operatively connected to (at least) the intermediate portion 16. Advantageously, embodiments of the device 10 of the present invention avoid, alleviate, or otherwise minimize the drawbacks or shortcomings of existing devices for retaining and positioning mail. Other advantages and technical effects of the embodiments of this invention will become evident to one skilled in the art from the following description.

The central body 14 defines a substantially planar surface 20 ("surface") at an angle relative to a portion of the tray 12. The central body 14 receives at least one mailpiece against the surface 20 and arranges the at least one mailpiece at an angle (e.g., the angle of the surface 20). The at least one intermediate portion 16, flanking the central body 14 on a side, provides a lateral boundary for the mailpiece received against the surface 20. In other words, the intermediate portion 16 maintains the mailpiece laterally within the extent of the central body 14. The at least one peripheral guide 18, connecting directly or indirectly to both the central body 14 and intermediate portion 16, engages with and extends along (e.g., in a direction transverse to the central body 14) a sidewall 22, extending away from a bottom surface 24 of the tray 12, to orient the device 10 relative to the tray 12 and to removably secure the device 10 to the tray 12. Specifically, in the depicted embodiments, the device 10 includes two peripheral guides 18. The peripheral guides 18 extend from opposing sides of the central body 14 in a direction transverse to the central body 14 such that the two peripheral guides 18 are arranged (or oriented) parallel to each other.

Figure 2A:
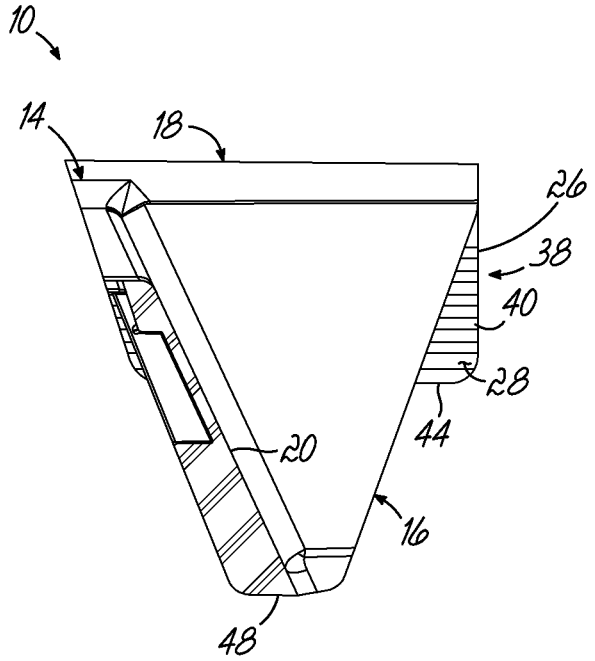
FIG. 2A is a cross-sectional view of the mail repositioning and retaining device of FIG. 1A.
Figure 2B:
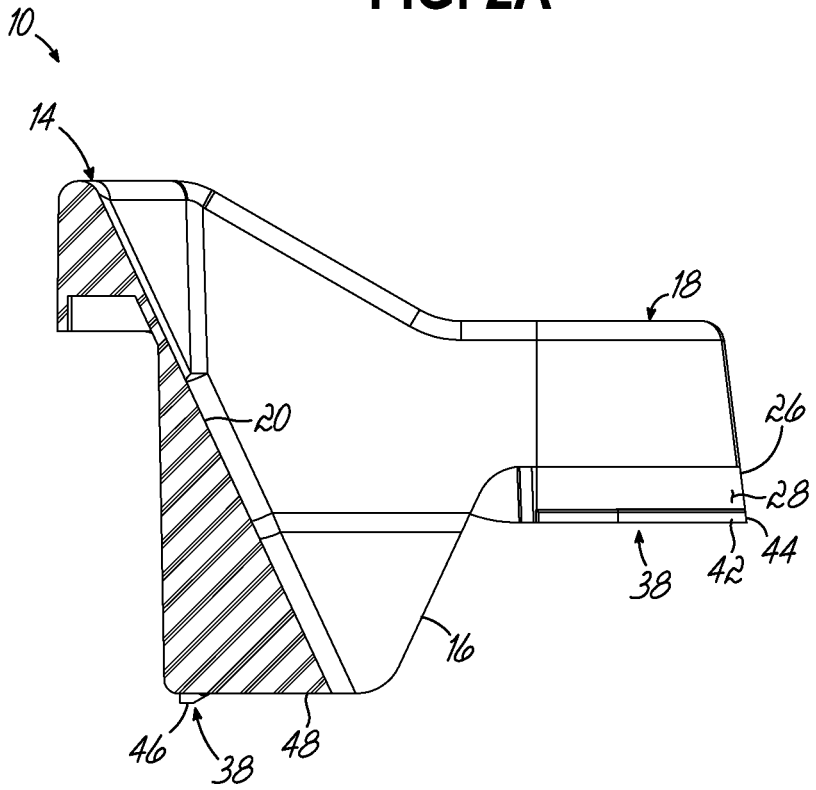
FIG. 2B is a cross-sectional view of the mail repositioning and retaining device of FIG. 1B.

Referring now to FIGS. 2A and 2B, the Figures depict cross-sectional views of the embodiments of the device 10. As shown, the surface 20 extends downwardly at an angle to the bottom (interior) surface 24 of the tray 12. In this way, the mailpieces within the tray 12 are maintained at a constant angle (e.g., the angle of the surface 20) with respect to the tray 12. The angle and size of the surface 20 are selected for optimal positioning of mailpieces for ease of viewing and handling. The angle between the surface 20 and a bottom surface 24 of the tray 12 may be between 45° and 90°—the angle measured between the bottom surface 24 of the tray 12 and the surface 20 of the device 10 immediately above the bottom surface 24 of the tray 12. Specifically, the angle between the surface 20 and the bottom surface 24 of the tray 12 may be approximately 65°. Here, "approximately" should be understood to mean+/−5°. Further, it is to be understood that the surface 20 may be arranged at an alternate angle with respect to the bottom surface 24 of the tray 12. The surface 20 is dimensioned (e.g., large enough) to prevent mailpieces from unintentionally travelling over or under the device 10 where the mailpiece may, for example, become concealed in the empty space in the tray 12 behind the device 10.

Figure 3A:
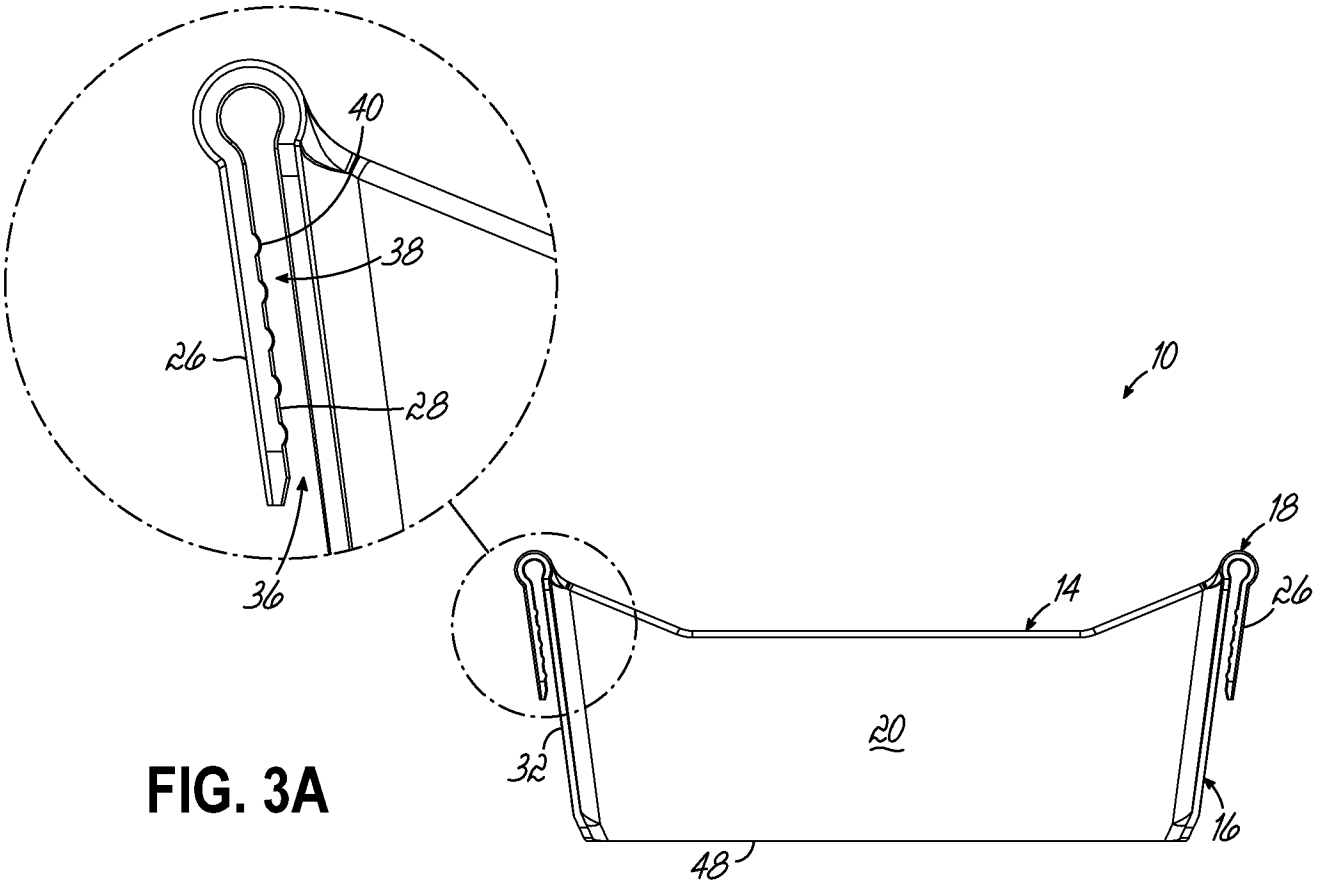
FIG. 3A is a front detailed view of the mail repositioning and retaining device of FIG. 1A.
Figure 3B:
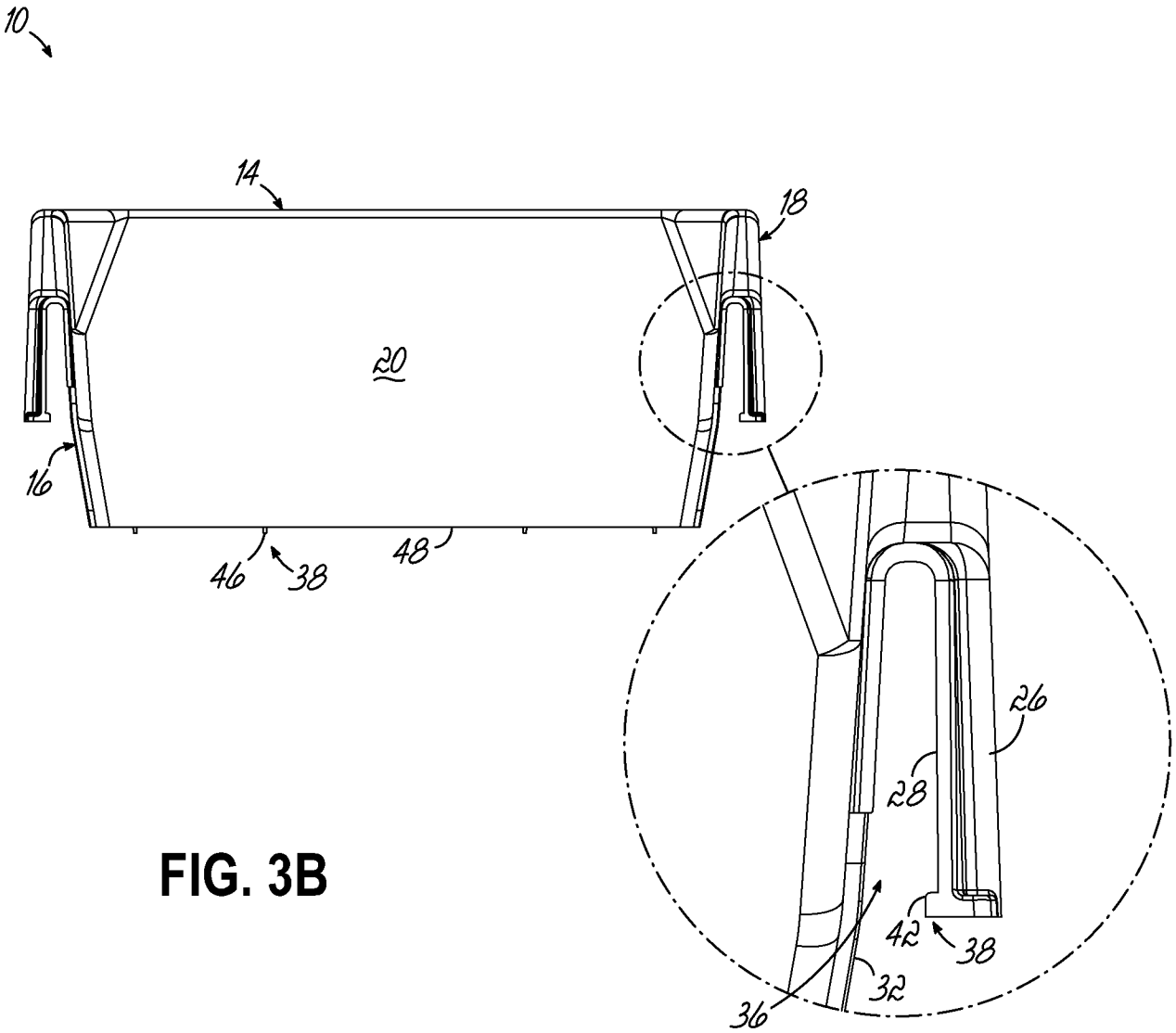
FIG. 3B is a front detailed view of the mail repositioning and retaining device of FIG. 1B.

Referring now to FIGS. 3A and 3B, the Figures depict front detailed views of the embodiments of the device 10. Specifically, the Figures show details of embodiments of the peripheral guide 18. When placing the device 10 into the tray 12, peripheral guides 18 grasp and straddle the sidewalls 22 of the tray 12. A flange 26 extends downwardly from the peripheral guide 18 such that an interior surface 28 of the flange 26 (or features thereof) interacts with the exterior surface 30 of the sidewall 22 of the tray 12. Similarly, an exterior surface 32 of the intermediate portion 16 (or features thereof) interacts with the interior surface 34 of the sidewall 22 of the tray 12. Further, the peripheral guide 18 forms a channel 36 between the flange 26 and the intermediate portion 16. The channel 36 receives the sidewall 22 of the tray 12 therein.

Broadly, friction and retention features 38 are utilized to retain the proper positioning or location of the device 10 within the tray 12 by the utilizing retention features 38 engaging with the sidewall 22 and/or bottom surface 24 of the tray 12. In the depicted embodiments, the flange 26 includes at least one retention feature 38 that engages with the sidewall 22 of the tray 12 to minimize undesired movement of the device 10 relative to the tray 12. Once the device 10 is placed onto the tray 12, the retention features 38 retain the device 10 onto the tray 12 and prevent the device 10 from falling out during use or by its own weight when the empty tray 12 is relocated (even if the tray 12 is inverted). FIG. 3A depicts a retention feature 38 in the form of a plurality of ridges 40. The ridges 40 extend from the interior surface 28 of the flange 26 towards the central body 14 (and the intermediate portion 16). The ridges 40 engage with the exterior surface 30 of the tray 12. FIG. 3B depicts a retention feature 38 in the form of a protruding lip 42. The lip 42 extends from a distal end 44 of the flange 26 towards the central body 14 (and the intermediate portion 16). Like the ridges 40, the lip 42 engages with the sidewall 22 of the tray 12.

With continued reference to FIG. 3B, the Figure also illustrates that the retention feature 38 need not be located on the flange 26. For example, the Figure depicts a retention feature 38 in the form of a plurality of fins 46 spaced apart from each other and extending away from a bottom 48 of the central body 14 towards a bottom surface 24 of the tray 12. Similar to the ridges 40 and lip 42 retention features 38, the plurality of fins 46 engage with the tray 12 to minimize undesired movement of the device 10 relative to the tray 12. However, the fins 46 engage with the bottom surface 24 of the tray 12 instead of with the sidewall 22 of the tray 12 (as with the ridges 40 and lip 42). Further alternative embodiments of retention features 38 are envisioned.

Figure 4A:
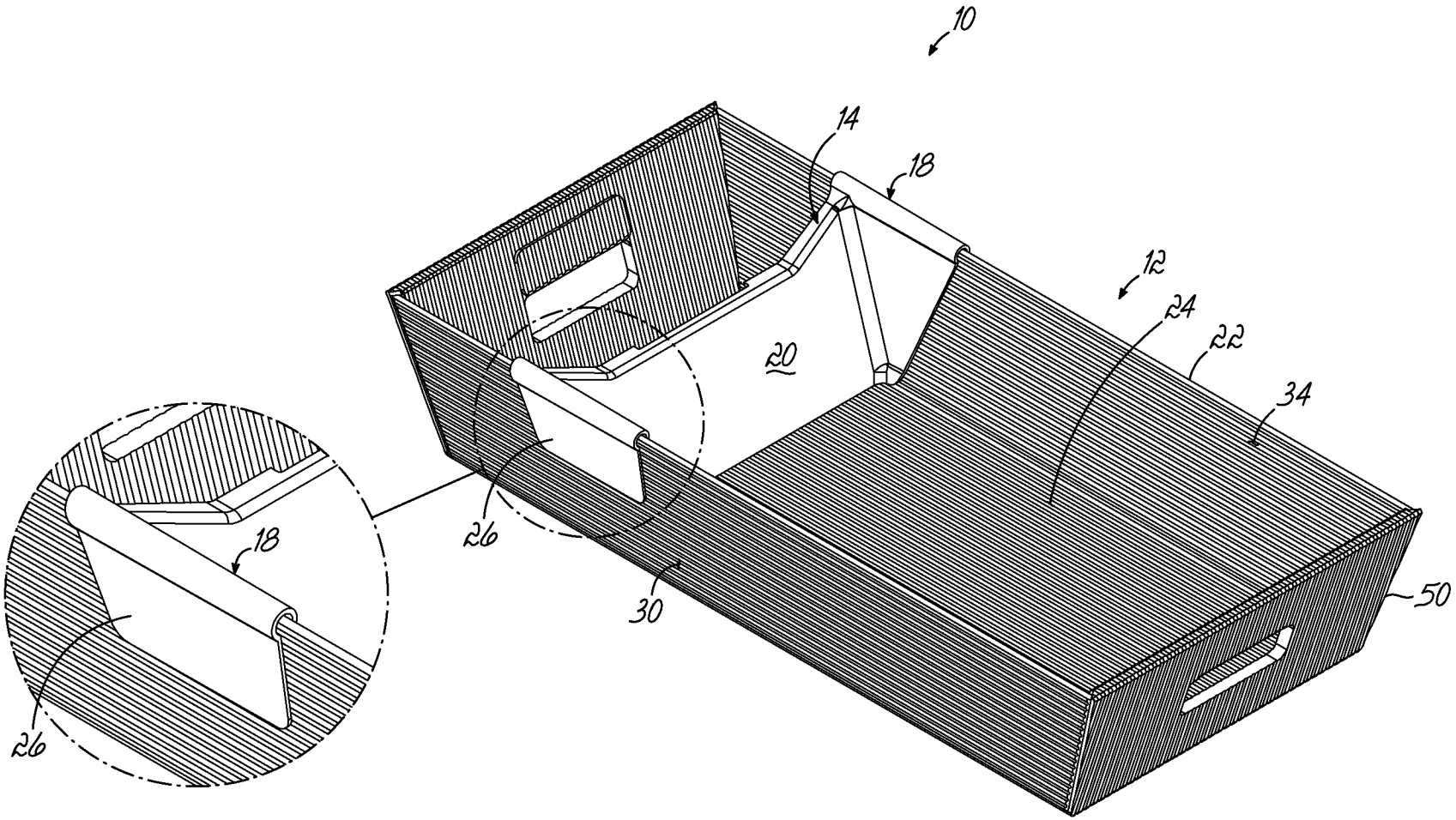
FIG. 4A is an environmental detailed view of the mail repositioning and retaining device of FIG. 1A.
Figure 4B:
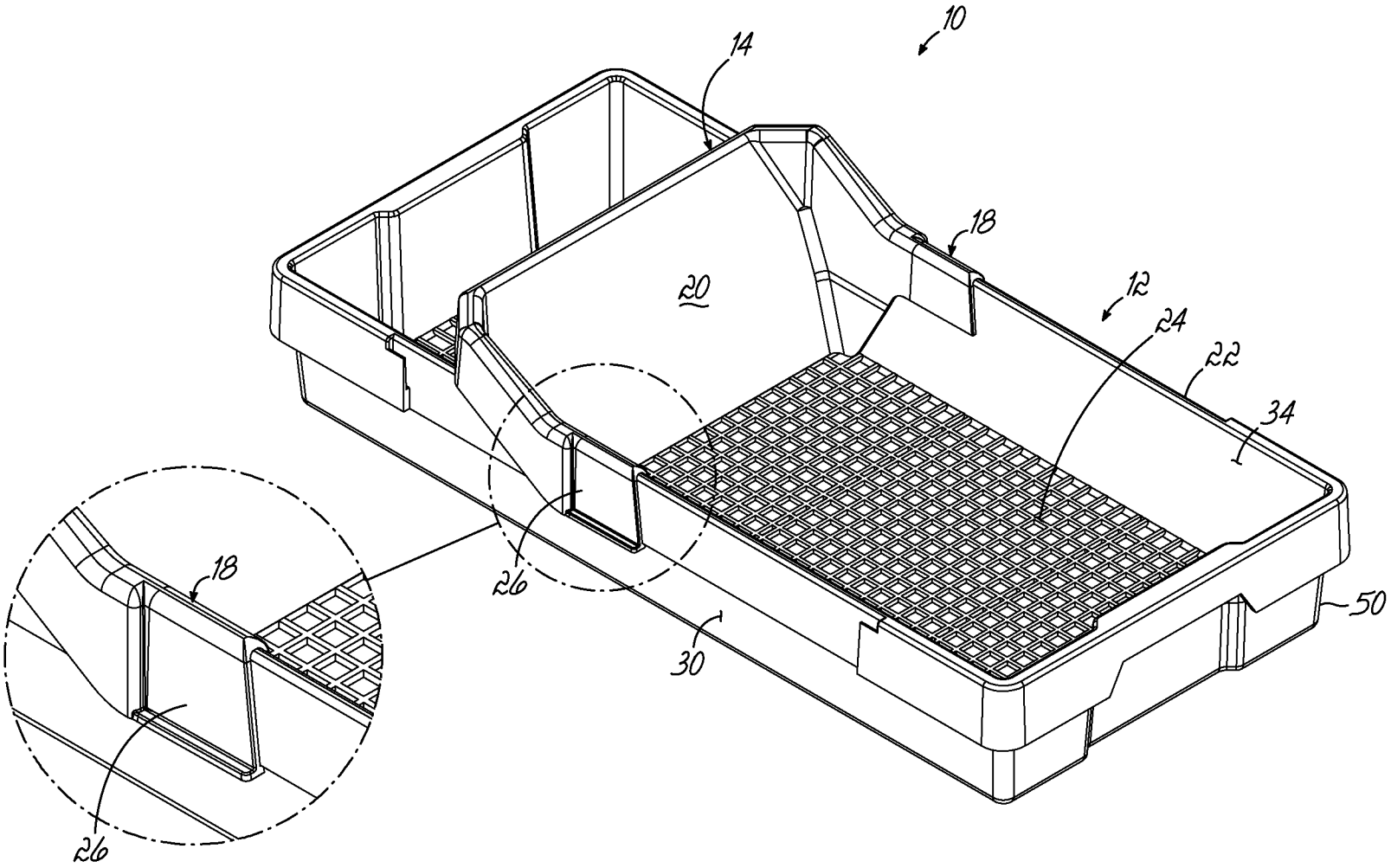
FIG. 4B is an environmental detailed view of the mail repositioning and retaining device of FIG. 1B.

Referring now to FIGS. 4A and 4B, the Figures depict embodiments of the device 10 located within trays 12. The device 10 can be placed into an empty, partially filled, or full tray 12 behind the furthest back mailpiece. The mailpieces will then be located in the tray 12 in front of the device 10 and oriented against the surface 20 of the device 10. During the delivery process, as mailpieces are removed from the tray 12, the device 10 can be easily moved forward by grabbing the device 10 and sliding the device 10 forward towards a front 50 of the tray 12. At least because the peripheral guides 18 are rigidly affixed to the device 10 and arranged parallel to each other (and retain perpendicularity with the sidewall 22), the device 10 can easily be moved with a single hand.

The peripheral guides 18 utilize the retention features 38 along with friction caused by interfering surfaces (e.g., between the interior surface 34 of the tray 12 and the exterior surface 32 of the intermediate portion 16) between the device 10 and tray 12 to facilitate retention of the position that the delivery professional choses without compromising ideal orientation and positioning of the mailpieces left in front of the device 10 in the tray 12. The previously described features of the device 10 allow for the adjustment of the device 10 in the tray 12 in as many different locations and number of times as the delivery professional chooses to be optimal to their preferences. The previously described device 10 features also allow for the same device 10 to be removed and reinstalled to the same tray 12 and/or another tray 12 repeatedly without rendering the device 10 and/or tray 12 unable to be used again.

Referring generally to FIGS. 1A-4B, the depicted device 10 is of unitary construction. The device 10 can be injection molded, vacuum formed, roto-molded, or 3D printed out of a thermoplastic, for example. It is to be understood that the device 10 may also be formed by an alternative process or method. The material of construction for the device 10 may be filled or unfilled Acrylonitrile Butadiene Styrene (ABS), Polycarbonate (PC), Polyvinyl Chloride (PVC), any derivative of Polyethylene (PE) (including but not limited to LLDPE, HDPE, UHMWPE, etc.), Polypropylene (PP), Polyamide (PA), or Polyoxymethylene (POM), for example. It is to be understood that the device 10 may also be fabricated out of any form of wood, metal, or other alternative suitable material.

While the present invention has been illustrated by the description of various embodiments and while these embodiments have been described in some detail, it is not the intention of the Applicant to restrict or in any way limit the scope of the invention to such detail. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A repositioning and retaining device for a mail delivery tray, the device comprising:

a central body configured to receive at least one mailpiece thereagainst, the central body defining a first side, a second side, and a substantially planar surface disposed between the first and second sides;

a first intermediate portion operatively connected and arranged substantially perpendicular to the first side of the central body, and a second intermediate portion operatively connected and arranged substantially perpendicular to the second side of the central body, the first and second intermediate portions configured to provide opposed lateral boundaries for the at least one mailpiece; and a first peripheral guide extending outward from the first side of the central body and in a direction transverse to the central body and operatively connected to the first intermediate portion, and a second peripheral guide extending outward from the second side of the central body and in a direction transverse to the central body and operatively connected to the second intermediate portion, the first and second peripheral guides configured to engage with a pair of sidewalls of the tray to orient the device relative to the tray and to removably secure the device to the tray, wherein the first peripheral guide includes a first flange extending from the first peripheral guide and spaced from the first intermediate portion so as to define a first channel therebetween that is configured to receive one of the pair of sidewalls, the first flange including at least one first retention feature configured to interact with the tray to minimize undesired movement of the device relative to the tray, wherein the second peripheral guide includes a second flange extending from the second peripheral guide and spaced from the second intermediate portion so as to define a second channel therebetween that is configured to receive the other of the pair of sidewalls, the second flange including at least one second retention feature configured to interact with the tray to minimize undesired movement of the device relative to the tray, and wherein the first flange extends along the first intermediate portion for a full length of the first intermediate portion and the second flange extends along the second intermediate portion for a full length of the second intermediate portion.

2. The device of claim 1, wherein the central body includes the at least one third retention feature, and wherein the at least one third retention feature includes a plurality of fins extending away from a bottom of the central body.

3. The device of claim 1, wherein the at least one first retention feature includes a plurality of ridges extending from an interior surface of the first flange, and wherein the at least one second retention feature includes a plurality of ridges extending from an interior surface of the second flange.

4. The device of claim 1, wherein the at least one first retention feature includes a protruding lip extending from a distal end of the first flange, and wherein the at least one second retention feature includes a protruding lip extending from a distal end of the second flange.

5. The device of claim 1, wherein the first peripheral guide is parallel to the second peripheral guide.

6. The device of claim 1, wherein the device is of unitary construction.

7. The device of claim 1, wherein the device is formed by a process selected from the group consisting of: injection molding, vacuum forming, roto-molding, and 3D printing.

8. The device of claim 1, wherein the device is formed of a material selected from the group consisting of: Acrylonitrile Butadiene Styrene (ABS), Polycarbonate (PC), Polyvinyl Chloride (PVC), any derivative of Polyethylene (PE), Polypropylene (PP), Polyamide (PA), and Polyoxymethylene (POM).

9. The device of claim 1, wherein the first intermediate portion extends from the first side of the central body for a full height of the central body at the first side, and wherein the second intermediate portion extends from the second side of the central body for a full height of the central body at the second side.

10. A system for repositioning and retaining mail, the system comprising:

a mail delivery tray, the tray comprising:

a bottom surface; and a pair of sidewalls extending away from the bottom surface; and the repositioning and retaining device according to claim 1 connected to the pair of sidewalls.

11. The system of claim 10, wherein the angle between the planar surface and the bottom surface of the tray is between 45° and 90°.

12. The system of claim 11, wherein the angle between the planar surface and the bottom surface of the tray is approximately 65°.

13. The system of claim 10, wherein the central body is configured to extend to the bottom surface of the tray to prevent the at least one mailpiece from passing between the bottom surface of the tray and the device.

14. A method of using a repositioning and retaining device for a mail delivery tray, the method comprising:

providing the tray, the tray including a bottom surface and a pair of sidewalls extending away from the bottom surface;

providing the device according to claim 1;

installing the device in the tray by engaging the first peripheral guide of the device with one of the pair of sidewalls of the tray, and engaging the second peripheral guide of the device with the other of the pair of sidewalls to orient the device relative to the tray and to removably secure the device to the tray; and selectively translating the device along the tray.

15. The method of claim 14, wherein the device includes a plurality of fins extending away from a bottom of the central body, and wherein the method further includes engaging the plurality of fins with a bottom surface of the tray.

16. The method of claim 14, wherein the at least one first retention feature includes a plurality of ridges extending from an interior surface of the first flange, wherein the at least one second retention feature includes a plurality of ridges extending from an interior surface of the second flange, and wherein the method further includes;

engaging the plurality of ridges on the first flange with an exterior surface of one of the pair of sidewalls of the tray; and engaging the plurality of ridges on the second flange with an exterior surface of the other of the pair of sidewalls of the tray.

17. The method of claim 14, wherein the at least one first retention feature includes a protruding lip extending from a distal end of the first flange, wherein the at least one second retention feature includes a protruding lip extending from a distal end of the second flange, and wherein the method further includes;

engaging the protruding lip on the first flange with one of the pair of sidewalls of the tray; and engaging the protruding lip on the second flange with the other of the pair of sidewalls of the tray.

18. The method of claim 14, further comprising maintaining the at least one mailpiece at a constant angle with respect to the tray.

19. A repositioning and retaining device for a mail delivery tray, the device comprising:

a central body configured to receive at least one mailpiece thereagainst, the central body defining a first side, a second side, and a substantially planar surface disposed between the first and second sides;

a first intermediate portion operatively connected and arranged substantially perpendicular to the first side of the central body, and a second intermediate portion operatively connected and arranged substantially perpendicular to the second side of the central body, the first and second intermediate portions configured to provide opposed lateral boundaries for the at least one mailpiece; and a first peripheral guide extending outward from the first side of the central body and in a direction transverse to the central body and operatively connected to the first intermediate portion, and a second peripheral guide extending outward from the second side of the central body and in a direction transverse to the central body and operatively connected to the second intermediate portion, the first and second peripheral guides configured to engage with respective sidewalls of the tray to orient the device relative to the tray and to removably secure the device to the tray, wherein the first peripheral guide includes a first flange extending from the first peripheral guide and spaced from the first intermediate portion so as to define a first channel therebetween that is configured to receive one of the respective sidewalls, the first flange including at least one first retention feature configured to interact with the tray to minimize undesired movement of the device relative to the tray, wherein the second peripheral guide includes a second flange extending from the second peripheral guide and spaced from the second intermediate portion so as to define a second channel therebetween that is configured to receive another of the respective sidewalls, the second flange including at least one second retention feature configured to interact with the tray to minimize undesired movement of the device relative to the tray, and wherein the at least one first retention feature includes a plurality of ridges extending from an interior surface of the first flange, and the at least one second retention feature includes a plurality of ridges extending from an interior surface of the second flange.

* * * * *